United States Patent [19]

Rodgers et al.

[11] Patent Number: 5,038,809

[45] Date of Patent: Aug. 13, 1991

[54] HIGH PRESSURE SOLVENTLESS MASK WASHER

[75] Inventors: Steven L. Rodgers, Sheridan; Delbert F. Jarvis, Lebanon; Christopher D. E. Rodgers, Noblesville, all of Ind.

[73] Assignee: Rodgers Finishing Tools, Inc., Lebanon, Ind.

[21] Appl. No.: 531,257

[22] Filed: May 31, 1990

[51] Int. Cl.[5] ..... B08B 3/02

[52] U.S. Cl. ..... 134/111; 134/140; 134/153; 134/161; 210/167; 210/396

[58] Field of Search ..... 134/104.4, 111, 140, 134/153, 155, 160, 161, 162; 210/167, 396

[56] References Cited

U.S. PATENT DOCUMENTS

| | | | |
|---|---|---|---|
| 555,671 | 3/1896 | Blackburn | 134/161 |
| 2,471,506 | 5/1949 | Wiswall | 134/111 X |
| 3,650,283 | 3/1972 | Lang | 134/162 X |
| 3,812,869 | 5/1974 | Szczepanski | 134/111 |
| 3,850,154 | 11/1974 | Fossati et al. | 134/111 Y |

FOREIGN PATENT DOCUMENTS

| | | | |
|---|---|---|---|
| 1412520 | 8/1965 | France | 134/161 |
| 0733745 | 5/1980 | U.S.S.R. | 134/153 |

*Primary Examiner*—Philip R. Coe

*Attorney, Agent, or Firm*—Woodard, Emhardt, Naughton, Moriarty & McNett

[57] ABSTRACT

A high pressure solventless mask washer. A mask holder is slidably and rotatably mounted on a shaft within a vessel having a door through which the mask may be inserted and mounted to the holder. A rotatable output extending into the vessel is connected telescopically slides causing rotation of the holder. A spline between the holder and shaft causes vertical movement of the holder as the holder is rotated. Washing liquid is directed outwardly from the shaft against the mask with the liquid then being circulated through a filter to a main reservoir. A doctor blade removes solid materials from the filter and deposits same in a solids accumulator. A pump removes any liquid from the accumulator compartment directing the liquid back through the filter salvaging same.

17 Claims, 5 Drawing Sheets

HIGH PRESSURE SOLVENTLESS MASK WASHER

BACKGROUND OF THE INVENTION

1. Field of the Invention

This invention is in the field of washers utilized for cleaning industrial materials.

2. Description of the Prior Art

Most industrial tools require periodic cleaning to insure the long life and proper use of the tool. Particularly, masks utilized in spray operations accumulate layers of paints and other chemicals through repetitive usage. It is the custom to mount such tooling including masks within a high pressure solventless washer which then sprays the masks with a cleaning liquid during a timed cycle. The paint particles and chemicals are mixed with the cleaning liquid thereby reducing the effectiveness of the liquid and subsequent cleaning operations. Various filtering systems have been utilized for removing some of the impurities from the cleaning liquid; however, there is still needed a superior method or structure for increasing the filtering of the cleaning liquid insuring more efficient use thereof. Disclosed herein is a system for salvaging and filtering the cleaning liquid.

The racks utilized to hold the tooling or masks within the washers may be stationary or movable past a plurality of spray nozzles. The racks are both vertically movable as well as rotatable around a vertical axis with the structure for moving the rack being mounted externally and atop the vessel. Due to the relatively large size of the vessels, the added height due to the rack driving structure is disadvantageous. Disclosed herein is a washer having a rotatable and vertically movable rack which has the structure for moving same located internally within the vessel thereby providing for a more compact washer as compared to the prior washers.

SUMMARY OF THE INVENTION

One embodiment of the present invention is a high-pressure, solventless mask washer comprising a vessel including a door through which masks to be washed may be inserted and withdrawn, a rack mounted in the vessel and operable to removably hold masks being washed in the vessel, a reservoir for holding washing liquid; a pump operable to circulate liquid from the reservoir through the vessel and back to the reservoir, a filter disposed between the reservoir and the vessel and operable to filter liquid moving therebetween and remove solid material from the liquid and to accumulate the solid material separate from the liquid, a liquid emitter to direct washing liquid onto the masks, a driver having an output extending into the vessel with the output having a longitudinal axis and being rotatable thereon but longitudinally stationary, and a movement device located entirely within the vessel and connected between the output and the rack being operable to both rotate and longitudinally move the rack with the masks past the liquid emitter.

Another embodiment of the present invention is a washer comprising a vessel including a door through which items to be washed may be inserted and withdrawn, a rack mounted in the vessel and operable to removably hold items being washed in the vessel, a reservoir for holding washing liquid, a circulating pump operable to circulate liquid from the reservoir through the vessel and back to the reservoir; a filter disposed between the reservoir and the vessel and operable to filter liquid moving therebetween and remove solid material from the liquid and to accumulate the solid material separate from the liquid, a solid material waste accumulator positioned to receive and hold the solid material, and, a secondary pump extending into the accumulator and operable to withdraw any liquid therein and direct same to the filter for filtering.

It is an object of the present invention to provide a new and improved high pressure solventless mask washer.

A further object of the present invention is to provide a washer utilized to clean industrial tools having new and improved means for salvaging the cleaning liquid utilized therein.

In addition, it is an object of the present invention to provide an industrial washer having internally therein a tool rack, the movement thereof being controlled by structure located internally within the vessel.

In addition to the above objects, it is an object of the present invention to provide a mask washer which is more efficient and compact as compared to the prior washers.

Related objects and advantages of the present invention will be apparent from the following description.

DESCRIPTION OF THE PREFERRED EMBODIMENT

Figure 1:
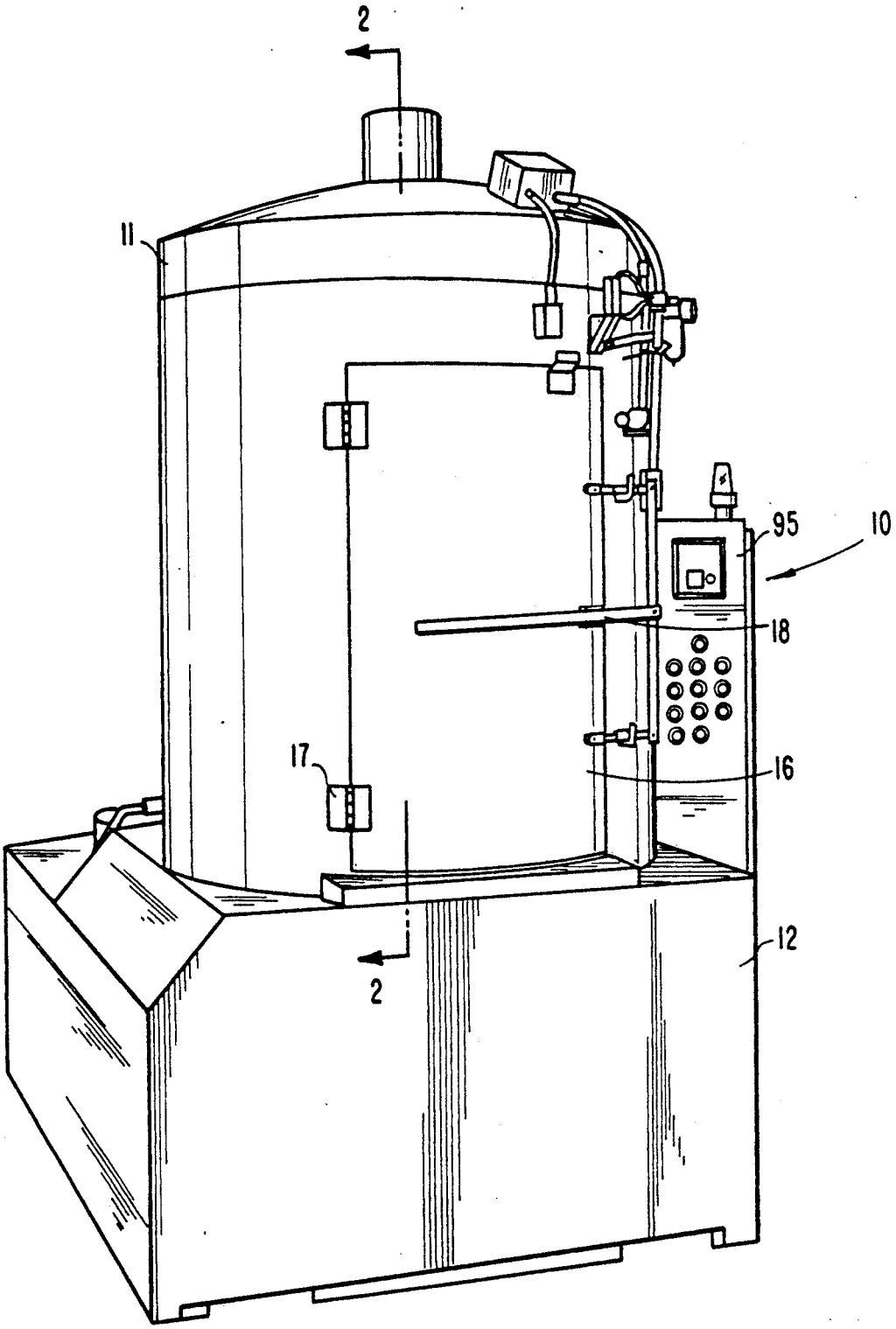
FIG. 1 is a perspective view of the mask washer.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a high pressure solventless mask washer 10 having a main vessel 11 mounted atop a cabinet or frame 12. Vessel 11 is produced from stainless steel and has a dome-shaped top wall 13 (FIG. 2) integrally mounted atop and joined to a pair of cylindrical walls 14 and 15 spaced apart to form a double-walled insulated construction. A door 16 is pivotally mounted by conventional hinge 17 and may be swung open for the insertion and removal of the items to be washed. A conventional handle 18 and locks are provided to open and lockingly close the door. In addition, conventional seals such as gaskets are mounted to the vessel and door to insure the sealed integrity of the vessel.

Figure 2:
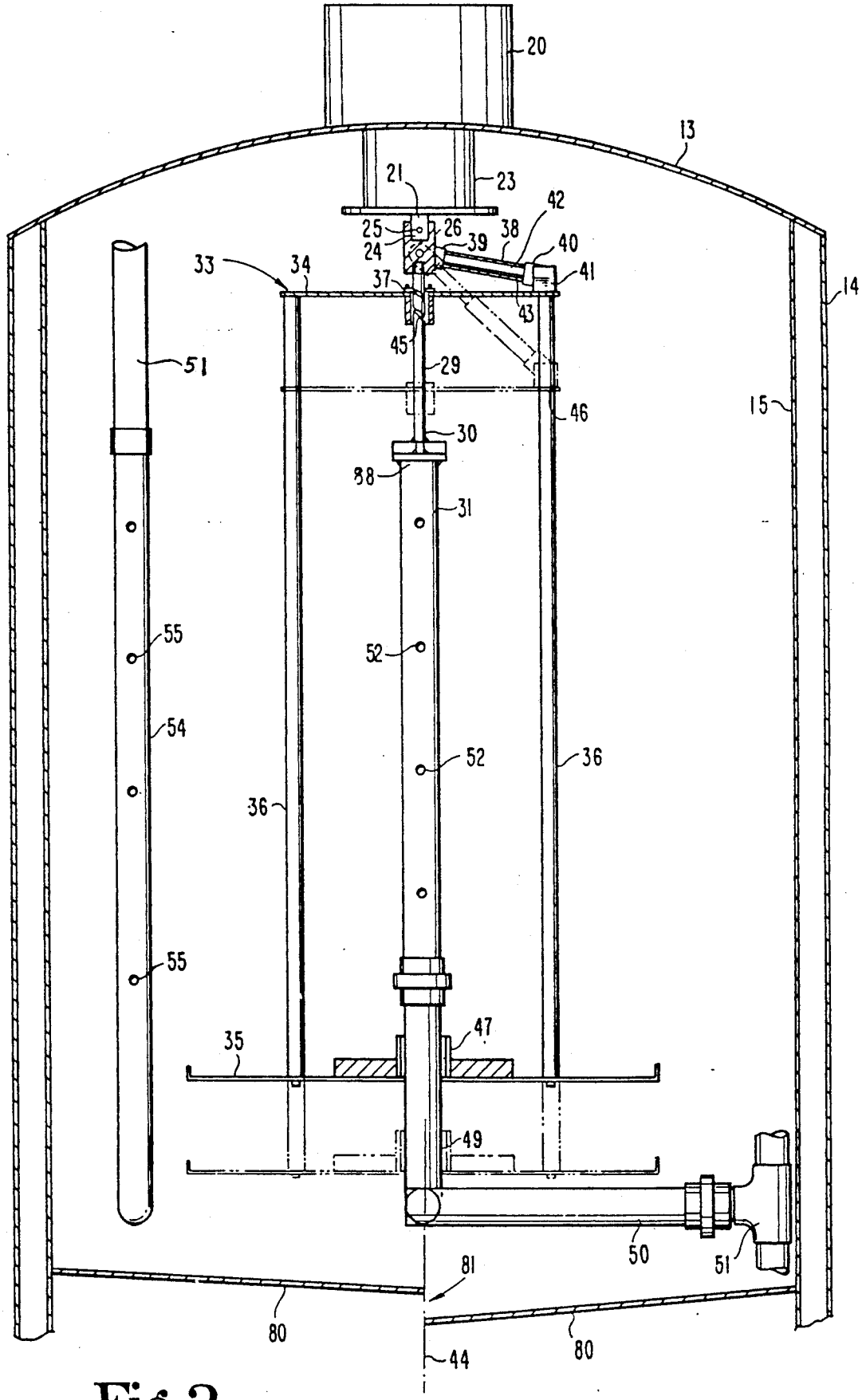
FIG. 2 is an enlarged fragmentary cross-sectional view taken along the line 2—2 of FIG. 1 and viewed in the direction of the arrows illustrating the construction of the vessel.
Figure 5:
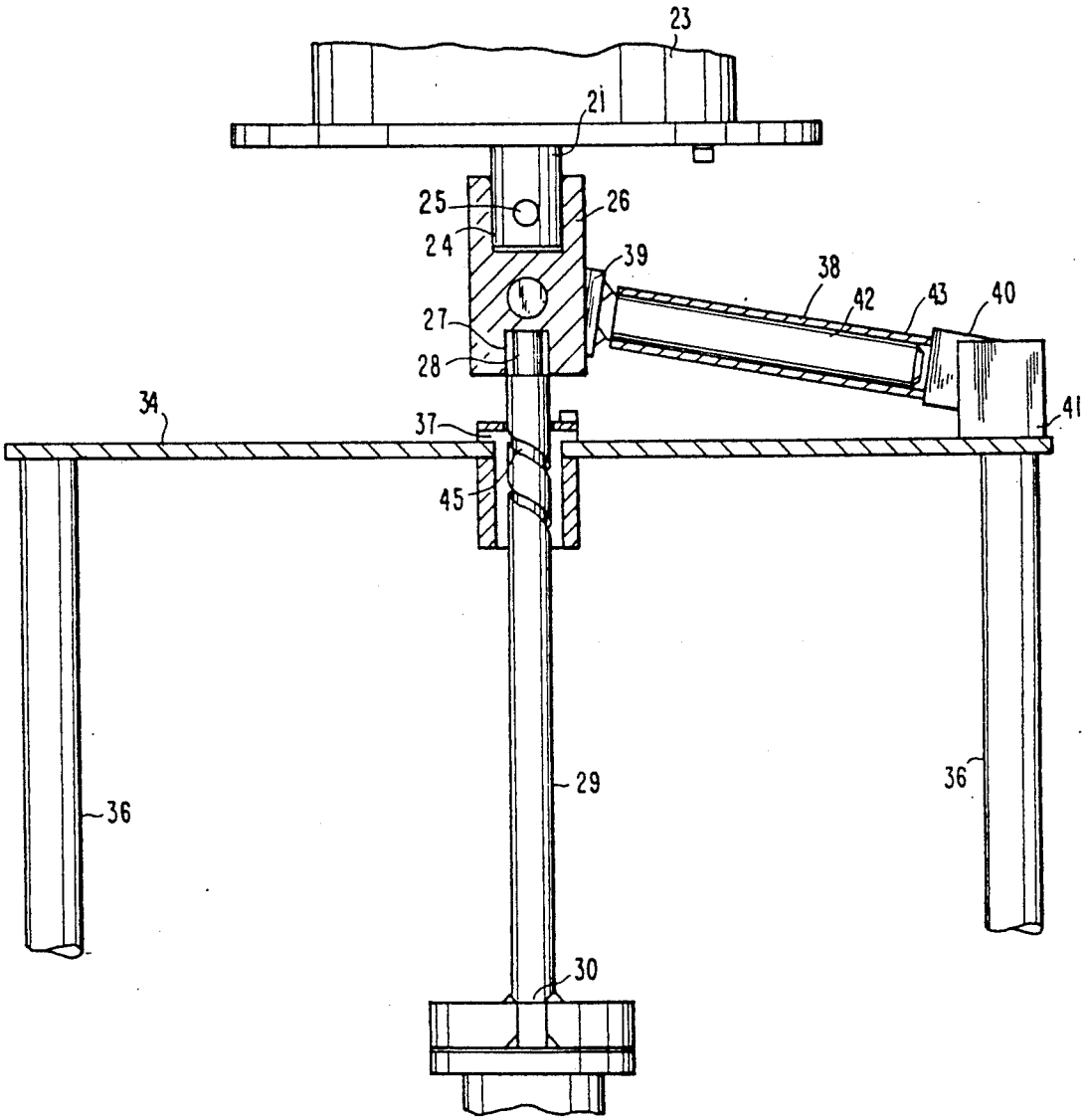
FIG. 5 is an enlarged fragmentary view of the top portion of the vessel of FIG. 2.

Mounted to the top of wall 13 is a conventional electric motor 20 having a rotatable output shaft or spindle 21. Spindle 21 extends through spindle housing 23 suspendedly mounted to wall 13. A conventional gear reducer is provided to insure the proper rotational speed of spindle 21. The bottom end 24 (FIG. 5) of spindle 21 is mounted by pin 25 to a knuckle connector 26. The opposite end of connector 26 has a cavity 27 receiving the reduced diametered top end 28 of rod 29 in turn having a bottom end 30 fixedly secured to the top end of tube 31 (FIG. 2). The bottom end 49 of tube 31 is fixedly mounted at the bottom of the vessel. The rotation of spindle 31 causes identical rotation of knuckle connector 26 whereas rod 29 remains stationary since connector 26 may rotate freely on the top end 28 of the rod.

A rack 33 for holding the items being washed is vertically slidable and rotatable on rod 29. The rack includes an upper plate 34 and bottom plate 35 connected together by a plurality of upstanding outer rods 36 which are secured to the plates by conventional fastening means such as by welding or bolts. Upper plate 34 includes mounted in the center thereof a nut 37 having a key or projection which extends into a keyway or spline 45 formed in rod 29. Spline 45 extends in a helical direction around shaft axis 44. A plurality of slides 38 include top ends 39 pivotally mounted to knuckle connector 26 and bottom ends 40 pivotally mounted to upstanding brackets 41 fixedly attached to and extending above upper plate 34. Each slide 38 includes a rod or piston 42 having a clevis forming at its upper end 39 pivotally attached to connector 26. Piston 42 is slidable within a cylinder 43 having its bottom end 40 also shaped in the form of a clevis pivotally mounted to upstanding brackets 41. In the embodiment shown in FIG. 2, three slides 38 are located equidistant around the longitudinal axis 44 of spindle 21. That is, a slide 38 is located every 120° around axis 44. The rotation of spindle 21 thereby causes rotation of the three slides 38 which in turn causes rotation of plate 34 and the resultant suspended rack 33 about axis 44. Rotation of plate 34 along with nut 37 about rod 29 causes the key or projection in nut 37 to follow the helical key way 45 formed in rod 29 in turn causing the upper plate 34 and rack 33 to ride vertically upward and downward along axis 44. Motor 20 has a reversible spindle with the result that rotation of the spindle in one direction causes plate 34 and slide 38 to move from the upward solid line position illustrated in FIG. 2 to the downward or dashed line position 46. By reversing the direction of the spindle, the plate 34 with the remaining portion of the rack 33 and slides 38 are caused to move upwardly from the lower dashed line position to the upward solid line position. Bottom plate 35 has an upright cylinder 47 slidably receiving tube 31 allowing the bottom end of the rack to slide freely in the vertical direction on the tube. Tube 31 has a closed top end 88 and a bottom end in turn attached to a horizontally extending tube 50. One end of tube 50 is connected to a supply header 51 in turn connected to a source of pressurized cleaning liquid. A plurality of conventional nozzles 52 are spaced along the length of tube 31 allowing the cleaning liquid to be sprayed outwardly against the items being held on rack 33 as the rack is rotated and moved vertically past the nozzles.

A plurality of upright tubes 54 are fixedly mounted to the interior wall 15 of the vessel and include a plurality of additional conventional nozzles 55 spaced along the length thereof. The top ends of upright tubes 54 are in turn connected to and are in fluid communication with supply header 51 in fluid communication with the source of pressurized cleaning fluid. Thus, as rack 33 is rotated and moved vertically, the items held on the rack are moved past the plurality of additional nozzles 55.

The items to be washed are suspendedly mounted by hangers in turn affixed to and extending between upright rods 36. In one embodiment, six upright rods 36 are provided on rack 33 and will accommodate three masks each having a length of up to 48 inches, a width of up to 24 inches and a thickness of up to 6 inches. The upright tubes 54 are mounted to wall 15 by camlocks for easy removal and cleaning. In the same embodiment, the washer included approximately 50 spray nozzles each producing 60–75 psi of cleaning action at the rate of 150 gallons per minute. In the same embodiment, the masks are clean, dry and ready for use in only 3 minutes.

Figure 3:
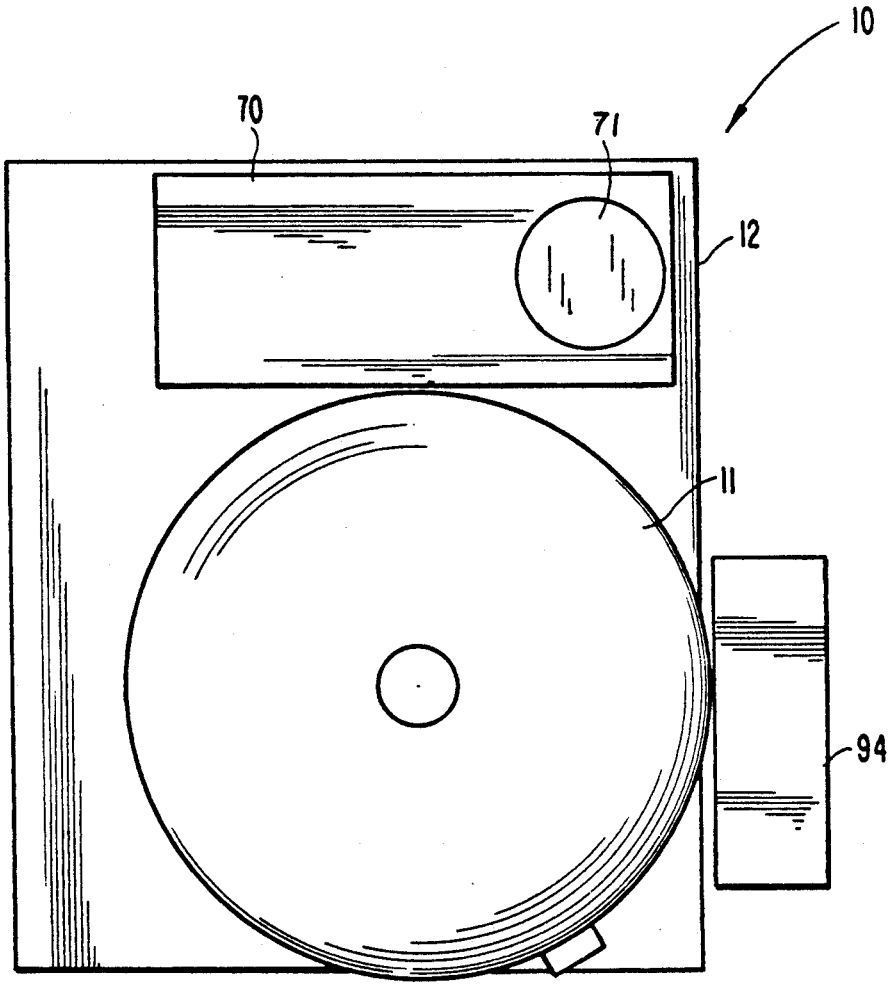
FIG. 3 is a top view of the washer of FIG. 1.

The cleaning fluid is initially contained in a reservoir or well 70 (FIG. 3) formed in cabinet 12. A conventional circulating pump 71 is operable to force the cleaning fluid from reservoir 70 to supply header 51 in turn connected to the upright tubes 54 and 31 for forcing the cleaning fluid outwardly against the items held or mounted to rack 33.

Figure 4:
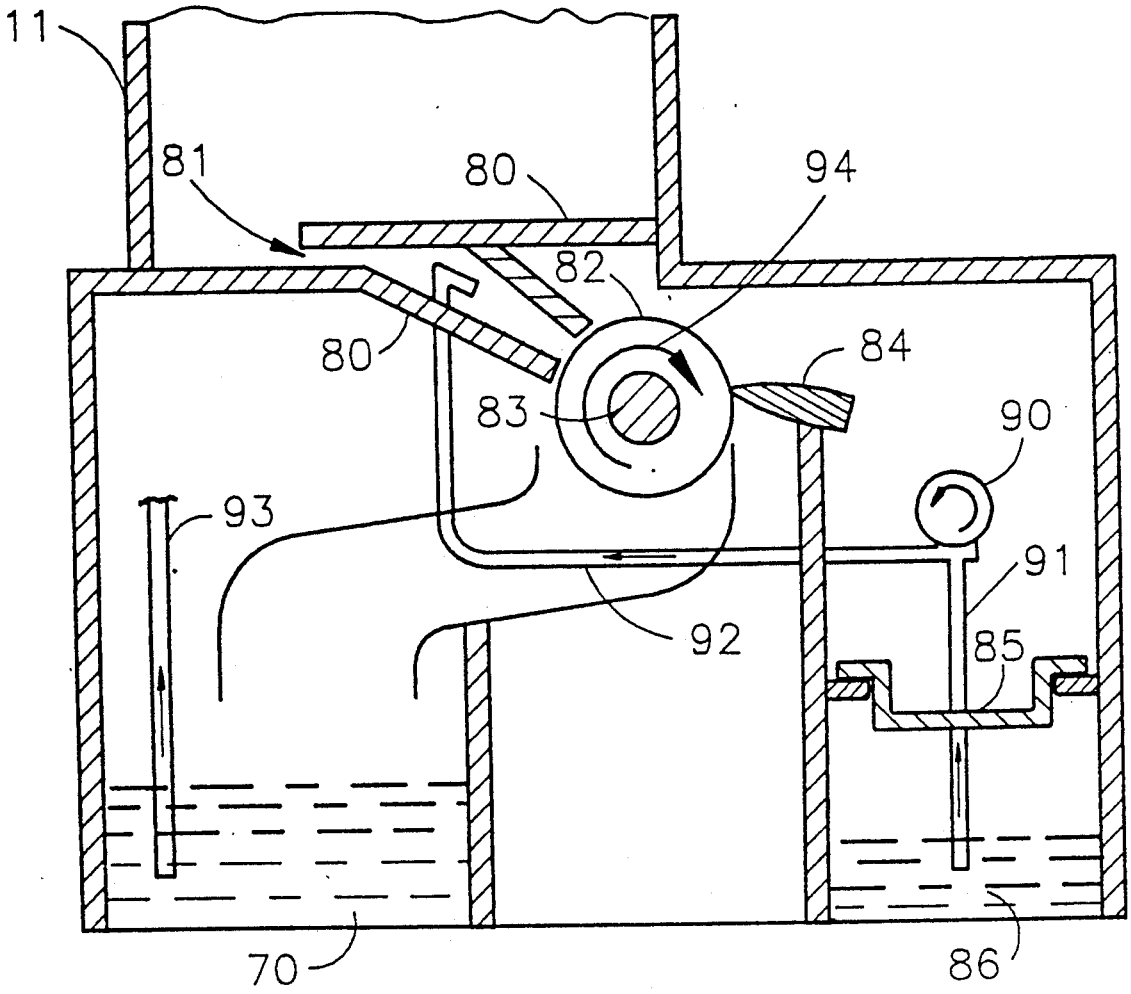
FIG. 4 is an enlarged fragmentary cross-sectional view showing the reservoir and filtering system.

The bottom wall 80 of the vessel is slopped downwardly forming an exit 81 through which the cleaning fluid exits the vessel. The bottom wall of the vessel may take many forms. In the embodiment shown in FIG. 2, the bottom wall is shown as a pair of mutually opposed downwardly sloping spaced apart walls which extend from the interior perimeter of the vessel downwardly towards the longitudinal axis 44 to the exit 81. Located beneath exit 81 (FIG. 4) is a rotofilter or drum 82 mounted about a longitudinal extending axle 83 for rotation in the direction of arrow 94. Axle 83 is mounted for rotational motion to the sidewalls of cabinet 12 and is rotatably driven by a conventional motor gear combination. Rotofilter 82 filters the paint particles from the cleaning solution. The paint or sludge is deposited onto the exterior cylindrical surface of drum 82 while the solution passes through a plurality of openings extending through the drum and then flows to the main reservoir of cleaning liquid 70. A doctor blade 84 is mounted adjacent to the drum 82 and cleans or scrapes off the exterior surface of the drum directing the paint and other impurities into a perforated basket 85 mounted over a secondary reservoir 86. Due to the scraping action of blade 84, a certain amount of the liquid on the outer surface of the drum will also flow over blade 84 into reservoir 86. The rotofilter is positioned beneath the main wash chamber and is also Positioned over reservoir 70. Rotofilter 82 is a cylindrical drum with a perforated outer surface allowing liquid to fall freely through one side of the drum and out the other side of the drum to the storage reservoir 70. Such rotofilters are typically used in the food processing industry and may be produced in a number of different configurations. One such configuration includes a drum having an outer surface formed by a wire spiraling along the length of the longitudinal drum axis. The adjacent coils of wires are spaced apart a sufficient distance to allow liquid to pass therebetween.

A standard pump 90 (FIG. 4) is mounted to cabinet 12 having an input tube 91 extending down into reservoir 86 and an outlet tube 92 opening over rotofilter 82. Pump 90 is operable to lift the liquid within reservoir 86 and direct the liquid onto the rotofilter where it is again filtered by the combined action of rotofilter 82 and blade 84 thereby reducing contamination of the cleaning liquid. Basket 85 may be removed from the cabinet to allow emptying of the paint particles collected therein. The basket is suspendedly held by conventional bracketry provided in cabinet 12. Circulating pump 71 has an inlet housing 93 extending down into reservoir 70 and is operable to force the pressurized cleaning liquid into supply header 51.

A housing 94 is mounted adjacent to the vessel having therein a computerized control panel 95 to control the mask wash and dry cycles. Conventional circuitry offers flexibility in changing wash and dry times. Further, the panel provides monitoring and control of heaters located within the reservoir allowing the temperature of the liquid to range from an ambient to 190° F. A conventional liquid level sensor within reservoir 70 is connected to a source of water providing for automatic water fill whenever the liquid within the reservoir falls below a predetermined level. Additional controls are provided for manual or automatic operation and provide for the control of the duration of the wash cycle.

In one embodiment, the mask washer was utilized to remove paint from the mask. Various types of washing liquids may be utilized. One such washing liquid is a water based biodegradable liquid available from Challenge, Inc., 7950 Georgetown Road, Indianapolis, Ind., under the designation "485S".

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A high-pressure, solventless mask washer comprising:

a vessel including a door through which masks to be washed may be inserted and withdrawn;

rack means mounted in said vessel and operable to removably hold masks being washed in the vessel;

reservoir means for holding washing liquid;

pump means operable to circulate liquid from said reservoir means through said vessel and back to said reservoir means;

filter means disposed between said reservoir means and said vessel and operable to filter liquid moving therebetween and remove solid material from said liquid and to accumulate said solid material separate from the liquid;

a liquid emitter connected to said pump means to direct washing liquid onto said masks;

drive means having an output extending into said vessel, said output having a longitudinal axis and being rotatable thereon but longitudinally stationary; and, movement means located entirely within said vessel and connected between said output and said rack means being operable to both rotate and longitudinally move said rack means with said masks past said liquid emitter.

2. The washer of claim 1 wherein:

said liquid emitter is stationary relative to said vessel.

3. The washer of claim 2 wherein:

said movement means includes first structure operable to direct rotation of said rack means and further includes second structure operable to direct vertical movement of said rack means.

4. The washer of claim 3 and further comprising:

an upright shaft with an longitudinal axis connected to said pump means and having a hollow interior to receive washing liquid, said shaft having said liquid emitter thereon in fluid communication with said hollow interior.

5. The washer of claim 4 and further comprising:

motor means mounted externally relative to said vessel and connected to said movement means; and wherein:

said rack means is slidably mounted on said shaft which is stationary, said movement means operable with said first structure directing rotation of said rack means on said shaft with said second structure directing reciprocation of said rack means along said longitudinal axis.

6. The washer of claim 5 wherein:

said motor means has a rotatable output connected to said movement means, said first structure includes a linkage connected between said output and said rack means to rotate said rack means with said output, said second structure includes a spline positioned between said shaft and said rotatable output and associated with said rack means to vertically move said rack means relative to said shaft as said output rotates said rack means.

7. The washer of claim 6 wherein:

said linkage includes a telescopically constructed slide with opposite ends pivotally connected respectively to said output and said rack means, said second structure includes a rod mounted to and between said output and said shaft, said spline includes a keyway and a interacting key formed on said rack means and said rod causing said rack means to move vertically along said axis as said rack means rotates about said axis and relative motion occurs between said key and said keyway.

8. The washer of claim 1 wherein:

said filter means includes a rotatable slotted drum and a doctor blade mounted adjacent and in contact with said drum, said drum positioned to receive from said vessel washing liquid with solid materials with said liquid flowing through said drum while said solid material is deposited onto said slotted drum and wiped off by said doctor blade as said drum rotates.

9. The washer of claim 8 wherein:

solid material waste receiving means positioned to receive and hold solid material from said doctor blade; and, secondary pump means operable to withdraw any liquid within said receiving means within said receiver means and direct same to said drum for re-filtering.

10. A washer comprising:

a vessel including a door through which items to be washed may be inserted and withdrawn;

rack means mounted in said vessel and operable to removably hold items being washed in the vessel;

reservoir means for holding washing liquid;

circulating pump means operable to circulate liquid from said reservoir means through said vessel and back to said reservoir means;

filter means disposed between said reservoir means and said vessel and operable to filter liquid moving therebetween and remove solid material from said liquid and to accumulate said solid material separate from the liquid;

solid material waste receiving means positioned to receive and hold said solid material; and, secondary pump means extending into said receiving means and operable to withdraw any liquid therein and direct same to said filter means for filtering.

11. The washer of claim 10 and further comprising:

movement means located entirely within said vessel and operable to direct rotation and vertical movement of said rack means.

12. The washer of claim 11 and further comprising:

an upright shaft with an longitudinal axis connected to said circulating pump means and having a hollow interior to receive washing liquid and a plurality of holes to allow said liquid to spray outwardly onto said items held by said rack means, said rack means being slidably mounted on said shaft which is stationary.

13. The washer of claim 12 and further comprising:

motor means with a rotatable output connected to said movement means, said movement means having a linkage connected between said output and said rack means to rotate said rack means with said output, said movement means including a spline positioned between said shaft and said rotatable output and associated with said rack means to vertically move said rack means relative to said shaft as said output rotates said rack means.

14. A mask washer comprising:

a vessel for insertion of masks to be washed;

a holder for holding said masks, said holder being rotatably and vertically movably mounted in said vessel;

a motor with a rotatable output extending into said vessel and vertically immovable therein, said output connected to said holder;

movement control means associated with said output and said holder, said control means being located entirely within said vessel for controlling and causing simultaneous rotation and vertical movement of said holder when said output rotates, said control means being operable for reversing vertical motion of said holder when said rotation of said output is reversed;

reservoir means for holding washing liquid; and, first pump means for forcing said washing liquid from said reservoir means into said vessel and against said masks.

15. The washer of claim 14 and further comprising:

filter means positioned to receive washing liquid from said vessel after said liquid has washed said masks carrying solid material therefrom; and, a waste reservoir to receive said solid materials from said filter means.

16. The washer of claim 15 and further comprising:

a secondary pump means operable to force any liquid from said waste reservoir to said filter means for filtering thereof.

17. The washer of claim 15 wherein:

said vessel has a sloping bottom floor directing liquid from said masks to said reservoir means.

* * * * *